US005641420A

United States Patent [19]

Peterson et al.

[11] Patent Number: 5,641,420

[45] Date of Patent: Jun. 24, 1997

[54] ELECTRIC HEATER HAVING COIL WITH LOOP THAT PASSES THROUGH APERTURE IN SUPPORT

[75] Inventors: John W. Peterson, Hawthorn Wood; Robert E. Stewart, Glencoe; Ernesto Flores, Chicago, all of Ill.

[73] Assignee: Lakewood Engineering & Mfg. Co., Chicago, Ill.

[21] Appl. No.: 524,324

[22] Filed: Sep. 6, 1995

[51] Int. Cl.[6] ..... H05B 3/06; H01C 7/22; F24H 3/00

[52] U.S. Cl. ..... 219/536; 219/546; 338/290; 338/305; 338/317; 392/365; 392/373

[58] Field of Search ..... 219/536–537, 219/532, 539, 546; 392/347, 360, 365, 373, 374; 338/286, 290, 305, 316, 318–319, 317

[56] References Cited

U.S. PATENT DOCUMENTS

| | | | |
|---|---|---|---|
| 1,024,234 | 4/1912 | Aller | 338/286 X |
| 2,530,806 | 11/1950 | Boxrud et al. | 338/286 X |
| 2,683,203 | 7/1954 | Burrows | 338/286 X |
| 2,834,867 | 5/1958 | White | 219/532 |
| 2,851,573 | 9/1958 | Muccilli | 392/374 X |
| 3,548,159 | 12/1970 | Ellstroem | 219/537 X |
| 3,812,322 | 5/1974 | Osterkorn et al. | 219/536 X |

OTHER PUBLICATIONS

Rival promotional materials (2 pages).

Patton promotional materials (1 page)—Metal Heater Series.

Holmes promotional materials (1 page)—Adjustable–tilt Heater 1500 watt.

Irca, U.S.A. promotional booklet (6 pages)—Resistenze elettriche a filo nudo per riscaldamento ambiente (with two color pages attached).

*Primary Examiner*—Teresa J. Walberg
*Assistant Examiner*—Raphael Valencia
*Attorney, Agent, or Firm*—Wallenstein & Wagner, Ltd.

[57] ABSTRACT

A heater element assembly for an electric heater, with a first and a second spaced element support. The first spaced element support has a peripheral edge surface and first and second slots extending inwardly from the edge surface, and an aperture therebetween; and a resistive heating element including first and second coiled sections and a connecting section disposed therebetween. The connecting section includes a mediate loop portion, wherein the first and second coiled sections are disposed between and engage the first and second spaced element supports. The connecting section extends through the slots, and the loop portion extends through the aperture, to secure the resistive heating element to the first element support.

15 Claims, 2 Drawing Sheets

ELECTRIC HEATER HAVING COIL WITH LOOP THAT PASSES THROUGH APERTURE IN SUPPORT

DESCRIPTION

1. Technical Field

This invention generally relates to heater element assemblies. More specifically, this invention relates to electrical heater element assemblies utilized in heat transfer devices, such as space heaters or cooking devices, and the method of manufacturing such heater element assembly.

2. Background of the Invention

There are many common heat transfer devices that utilize electrical heater element assemblies, for example, space heaters. Space heaters are frequently used to provide heat to an area surrounding the space heater. Space heaters may provide additional heat to supplement a primary heat source or may even provide the primary heat source. Accordingly, space heaters are made in many different sizes with various heat producing capacities. Relatively low capacity space heaters are frequently used to provide heat to a localized area surrounding the space heater. Relatively high capacity space heaters may heat a larger area and provide a greater increase in the surrounding temperature. Such heaters may either utilize radiant heat emitted from a heating element, or may provide for convection heating by forcing air to pass over a heating element and thereby emit heated air.

Other examples of appliances which utilize electric heating element assemblies to emit radiant or convection/radiant heat including cooking appliances, such as ovens and toasters, as well as hair drying appliances. Typically, these appliances include heating element assemblies which utilize a heating coil or filament which is wrapped around a solid non-conductive material, such as a ceramic rod. Other such appliances utilize heating coils or filaments attached to a non-conductive board material, such as mica, by a hook provided on the mica board, or by simply wrapping the element around the mica board. In this manner, such existing appliances utilize the same types of heating element attachment as space heaters. Regardless of the particular appliance, it is difficult to align the heating elements in a secure position, while providing even distribution of the elements over the area of the heating element assembly. It is particularly difficult to securely fasten a heating element between a plurality of element support structures.

The present invention is described below in relation to a relatively small space heater. However, the principles of the present invention are applicable to larger size and larger capacity space heaters. The principles of the present invention may also be applicable to other devices utilizing electrical heater element assemblies, for example, radiant heaters, convection heaters, toasters, hair dryers, and toaster ovens.

Existing space heaters have utilized known electrical heater element assemblies. For example, one known heater element assembly includes two flat boards that are spaced apart from each other. A heater wire, which may have a coil shape, extends from one board to the other board. Opposing ends of sections of the heater wire are connected to the opposing boards by hooks contained on the boards. With this type of assembly, the wire (or coil) is simply engaged with the hook at the ends of the wire, and at sectional points along the wire.

These existing hooked heater element assemblies exhibit problems. For example, attaching the heater wire to the hooks is labor intensive and is difficult to accomplish efficiently. Thus, manufacturing of hooked heater element assemblies is inefficient and costly. Further, hooked heater element assemblies may not securely hold the heater wire taught between the opposing boards, resulting in potential failure of the heater element attachment, which may cause electrical shock or fire. Also, the heater wire expands when heated and contracts as the wire cools. The wire expansion and contraction results in loose or sloppy heater wires because the wire is not secured taught against the boards. In the case of convection/radiant heaters, the heater wire may rattle or move when a fan blows air over the wire.

Another known heater element assembly includes a single flat board having a series of spaced openings through the board. A ribbon heater element is woven through the holes, looped back and forth to form a woven zig-zag type pattern. Each hole in the board has two legs of a loop extending through the hole. In this manner, the ribbon heater element weaves through the holes and extends away from one or both sides of the board. This heater element assembly may also have two opposed flat boards, whereby the ribbon weaves through the holes in both boards, such that the ribbon extends between the boards and beyond the opposite sides of each board.

These existing heater element assemblies using ribbon heater strips also exhibit problems. For example, the ribbon heater strips are susceptible to deformation or misalignment, such as may result from handling of the appliance during shipment, or dropping and sudden jolting of the appliance during use, or by some object coming into contact with the ribbon element. Deformation or misalignment of the heating element may result in failure of uniform heating, electrical shock or fire. Further, the ribbon is subject to breakage, resulting in potential catastrophic failure of the heating element. Also, since the effectiveness of the heating element is often a function of the amount of element surface area in a given space, using a ribbon heating element would likely necessitate a large matrix of looped ribbon sections, and the use of such ribbon element arrangements has very limited use in radiant heater appliances in the absence of convection.

Therefore, a need exists to improve heater element assemblies. There is a need to improve the efficiency and cost of manufacturing heater element. assemblies and to improve the attachment of a heater element to a support. The present invention satisfies this and other needs to improve electrical heater element, assemblies. The present invention securely attaches heater elements to opposing support boards by pressing portions of the element through holes in the boards. The heater elements remain securely fastened to, and taught against, the support boards. Further, the use of hooks to secure the elements are eliminated, and the heating element is secured in a manner which permits even distribution of the heating element across the heating element assembly.

Other aspects and advantages of the present invention will become apparent after reading this disclosure, including the claims, and reviewing the accompanying drawings.

SUMMARY OF THE INVENTION

The present invention provides a heater element assembly for an electric heater comprising a first and a second spaced element support. The first spaced element support has a peripheral edge surface and first and second slots extending inwardly from the edge surface, and an aperture therebetween. The invention also provides a resistive heating element including first and second coiled sections and a connecting section disposed therebetween. The connecting section includes a mediate loop portion, wherein the first and second coiled sections are disposed between and engage the first and second spaced element supports. The connecting section extends through the slots, and the loop portion extends through the aperture, to secure the resistive heating element to the first element support.

The present invention further provides a method of assembling a heater element assembly for an electric heater, comprising the steps of providing a first and a second spaced element support, the first spaced element support having a peripheral edge surface and first and second slots extending inwardly from the edge surface, and an aperture therebetween. The method includes providing a resistive heating element including first and second coiled sections and a connecting section disposed therebetween, the connecting section including a mediate loop portion. The method further including disposing the first and second coiled sections between and in engaging relation with the first and second spaced element supports such that the connecting section extends through the slots, and extending the loop portion through the aperture to secure the resistive heating element to the first element support.

DETAILED DESCRIPTION OF THE PREFERRED EMBODIMENT

Although the present invention can be made in many different forms, the preferred embodiments are described in this disclosure and shown in the attached drawings. This disclosure exemplifies the principles of the present invention and does not limit the broad aspects of the invention only to the illustrated embodiments.

Figure 1:
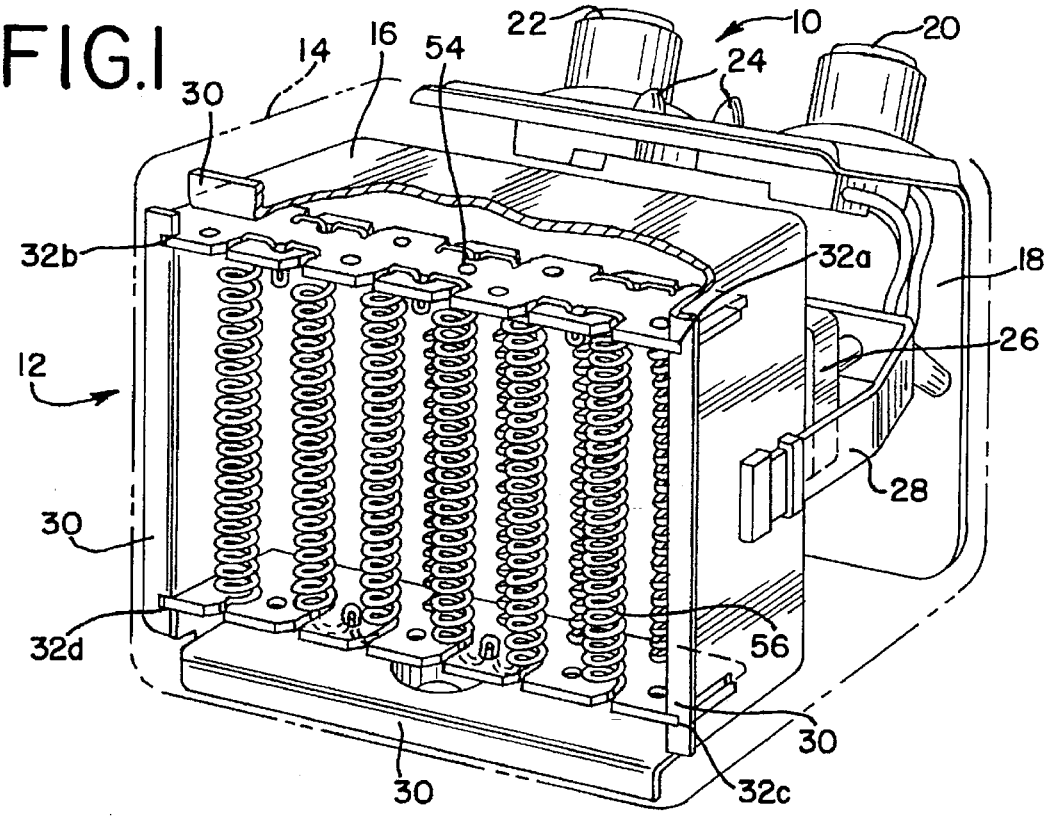
FIG. 1 is a perspective view of a space heater containing a heater element assembly made in accordance with the principles of the present invention.

FIG. 1 shows a perspective view of a space heater 10 containing a heater element assembly 12 made in accordance with the principles of the present invention. The space heater 10 also includes a heater housing 14 (partially shown and in phantom lines), an element housing 16 containing the heater element assembly 12, a back panel 18, and a front grill (not shown). An on\off control switch 20, a thermostat 22, a pair of indicator lights 24, and a fan 26 are mounted on the back panel 18 of the space heater 10. Appropriate wiring is provided to electrically connect the electrical components of the space heater 10. A bracket plurality 28 (shown as a single U-shaped bracket) is removably fastened to the back panel 18 and to the element housing 16 to position the element housing 16 in relation to the blades of the fan 26. The on\off switch 20 may be a four-position switch, including the positions of 1) heater off and fan off, 2) fan on and heat off, 3) fan on and heat on low, and 4) fan on and heat on high. The heater housing 14 and the back panel 18 may include air vents or louvers (not shown) to permit air flow through the space heater 10.

The heater element assembly 12 is slidably mounted on the element housing 16. The element housing 16 has an open front side and an opposed open back side (not shown). The back side opening is circular to coincide with the fan blades of a fan 26. The element housing 16 includes tabs 30 which extend from a front edge of the front side of the element housing 16. The top tab 30 extends vertically from the front edge at an angle of approximately 90° from the top of the element housing 16. The bottom, right, and left tabs 30 extend from the front edge at an angle of approximately 90° to the bottom, right, and left sides, respectively, of the element housing 16. The tabs 30 are provided to abut the inside of the heater housing 14 when the space heater 10 is completely assembled.

The element housing 16 provides a slot 32*a* near the top of the right side and a corresponding slot 32*b* near the top of the left side. Similarly, a slot 32*c* is provided near the bottom of the right side and a corresponding slot 32*d* is provided near the bottom of the left side. The slots 32*a*–32*d* may also extend through the tabs 30 on the right side and the left side of the element housing 16. The slots 32*a*–32*d* are provided for slidably and removable mounting the heating element assembly 12 on the element housing 16.

Figure 2:
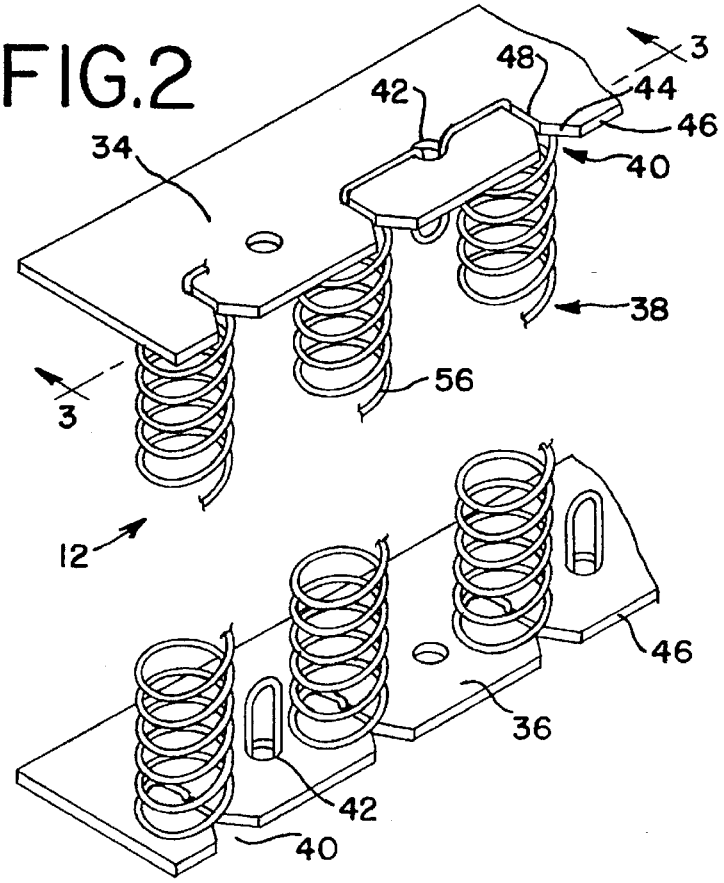
FIG. 2 is a perspective view of a portion of the heater element assembly of FIG. 1.

FIG. 2 shows a perspective view of a portion of the heater element assembly 12 of FIG. 1. The heater element assembly 12 includes a top element support 34, a bottom element support 36, and a heater element 38. The top element support 34 is spaced apart from the bottom element support 36 and the heater element 38 is supported by and extends from one element support to the other element support.

The top element support 34 is made from an electrical insulation material, for example, mica board or a mylar and ceramic material. The top element support 34 has heat resistant properties to withstand the temperatures generated by the heater element assembly 12. The bottom element support 36 is similar to the top element support 34.

The top and bottom element supports 34, 36 have a series of alternating slots 40 and aperture 42 for mounting the heater element 38. Referring to the top element support 34, the slot 40 includes a notched portion 44 adjacent on edge 46 of the top element support 34. The slot 40 also includes a straight portion 48 extending from the notched portion 44 into the top element support 34. The notch 44 is V-shaped and has a relatively wide opening at the edge 46 of the top element support 34 and narrows to a smaller opening that merges with the straight portion 48.

Figure 5:
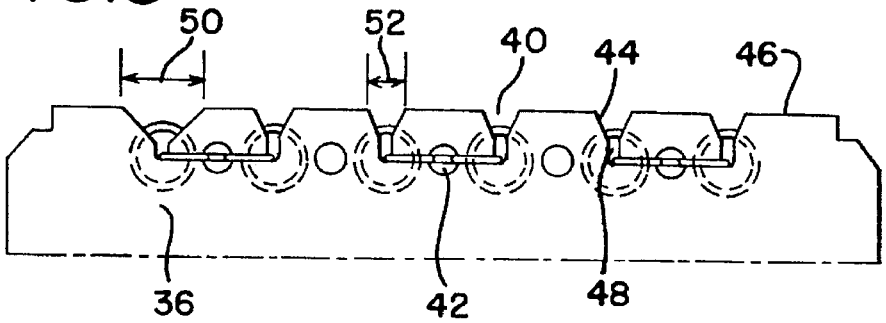
FIG. 5 is a bottom view of the heater element assembly of FIG. 2.

As shown in FIG. 5, the V-shaped notch 44 at one end of the bottom element support 36 may have a wider opening 50 than the openings 52 in the other V-shaped notches. The top element support 34 may also have a V-shaped notch with a wider opening than the opening in the other notches in the top element support 34.

Referring to FIG. 2, the aperture 42 are preferably round; but, the aperture 42 may be made in other shapes, for example, square. The slots 40 and aperture 42 are alternately arranged such that a aperture 42 is positioned between two slots 40 and a slot 40 is positioned between two apertures 42. However, as shown in FIG. 5, the top and bottom element supports 34, 36 have slots 40 at the outside edges of the element supports.

Referring to FIG. 1, the heater element assembly 12 is shown assembled onto the element housing 16. Particularly, the top element support 34 is slidably engaged in the slots 32 near the top of the right and left sides of the element housing 16. Likewise, the bottom element support 36 is slidably engaged in the slots 32 near the bottom of the right and left sides of the element housing 16.

The top and bottom element supports 34, 36 may have other holes or perforations. For example, FIG. 1 shows a hole located approximately near the center of the top element support 34. The hole 54 may be used for additional fastening of the top element support 34 to the element housing 16.

Referring to FIG. 2, the heater element 38 is an element, such as a wire, that generates heat as electrical current flows through the wire due to the wire's resistance to the electrical current flow. Accordingly, the heater element 38 is electrically connected to the controls of the space heater 10. The heater element 38 is supported by and extends from the bottom element support 36 to the top element support 34 as described in greater detail below in regards to FIGS. 3–5. The heater element 38 is shown in FIG. 2 as wire formed into a series of spaced coils 56 having a circular shape, and separated by a series of linear segments Alternatively, the heater element 38 could be made in many different forms, for example a straight wire between the two element supports 34, 36, a wire formed into a "zig zag" shaped pattern, or a coil having a square or other shape.

Figure 3:
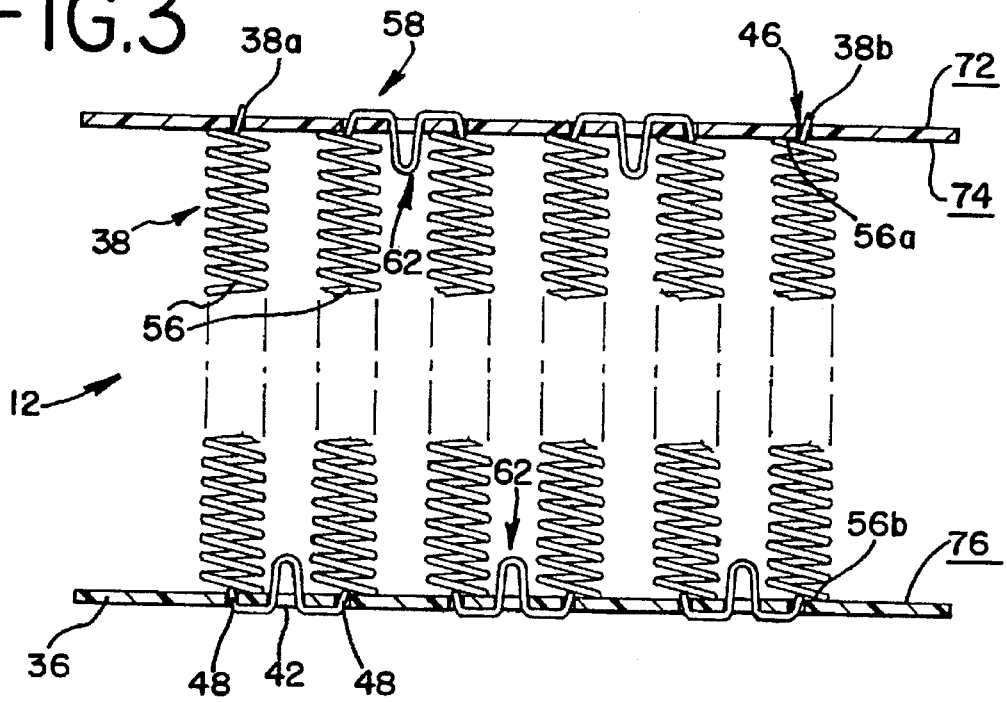
FIG. 3 is a cross-sectional view of the heater element assembly of FIG. 2 along the line 3—3.

FIG. 3 shows a cross-sectional view of the heater element 12 assembly of FIG. 2 along the line 3—3. The heater element 38 is a continuous wire formed into a series of coils 56 that are aligned in a row. Each coil 56 is spaced apart from an adjacent coil 56 by a linear segment 58 of the wire element 38. The heater element wire 38 has two ends 38*a*, 38*b*. Each end 38*a*, 38*b* of the wire element 38 terminates at the outside coils of the row of coils 56. Although not shown, the wire element ends 38*a*, 38*b* are electrically connected to the controls of the space heater 10 and to an electrical power source. The wire element ends 38*a*, 38*b* may also be fastened to the element supports 34, 36 by conventional means.

As shown in FIG. 3, each coil 56 extends from one element support 34 or 36 to the other element support 34 or 36. The end 38*a* of the heater element wire 38 is fastened to the top element support 34. The wire element 38 passes down through the straight portion 48 of the slot 40 in the top element support 34 and connects to the coil 56. The coil 56 extends downward to the bottom element support 36. At the bottom of the coil 56, the wire element 38 passes down through the straight portion 48 of the slot 40 in the bottom element support 36, loops up and down through the bottom aperture 42, and extends upward through the next slot 40 in the bottom element support 36. The wire element 38 connects to the next coil 56 which extends upward to the top element support 34. This pattern is repeated for the desired number of coils 56. The end 38*b* of the last coil 56 passes through the last slot 40 and is fastened to top element support 34.

The present invention is described as shown in FIG. 3 with the end 38*a* of the first coil 56 attached to the top element support 34. However, the end 38*a* of the first coil 56 could be fastened to the bottom element support 36. Accordingly, the above references to upward and downward directions are arbitrary and could be reversed.

Figure 4:
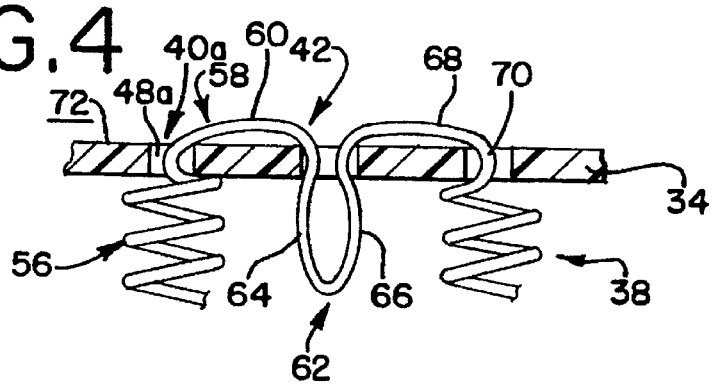
FIG. 4 is an enlarged view of a portion of FIG. 3 showing a heater element mounted on an element support.

Referring to FIG. 4, the mounting of the heater element wire 38 to the top element support 34 is shown in greater detail. The heater element wire 38 comprises a coil 56 extending upward from the bottom element support 36. The coil 56 is connected to a linear segment 58 that passes upward through a first straight portion 48*a* of a first slot 40*a*. The linear segment 58 includes a transverse section 60 that extends from the terminal end of the coil 56. The transverse section 60 is positioned on a side 72 of the top element support 34 that faces away from the bottom element support 36.

The linear segment 58 includes a loop segment 62 that passes through the aperture 42. The loop segment 62 comprises a first leg 64 connected to the transverse section 60 and extends downward through the aperture 42 towards the bottom element support 34. A second leg 66 of the loop segment 62 is connected to the first leg 64 and extends back upward through the aperture 42. The loop segment 62, particularly the second leg 66, is connected to a second transverse segment 68 that extends from the aperture 42 along side 72, to a transition in segment 70 of the elements 38.

The loop segment 62 extends downward through the aperture 42 toward the bottom element support 34 to draw the coils 56 toward the element supports 34, 36, such that the terminal ends 56*a*, 56*b* (FIG. 3) contact and abut against the ends of the coils 56. Accordingly, the coils 56 are maintained taught against the top and bottom element supports 34, 36, providing secure attachment and minimizing the amount of slack in the coils 56. The coils 56 remain taught against the top and bottom element supports 34, 36 even after repeated heating and cooling of the heater element 38.

Portions of the heater element wire 38 may be embedded into the element supports 34, 36. Particularly, portions of the linear segment 58, transverse section 60, loop segment 62, and the second transverse section segment 68 may be embedded into the element supports 34, 36. Embedding the element 38 into the element supports 34, 36 further secures the element 38 to the element supports 34, 36 and assists in retaining tension on the coils 56.

FIG. 5 shows a bottom view of the heater element assembly 12 of FIG. 2. The shape of the slots 40 and the apertures 42 are shown more clearly in FIG. The apertures 42 are shown as being round, but may be made in any desired shape. As discussed above, the slots 40 have a V-shaped notch 44 adjacent the edge 46 of the element support 36. The V-shaped notch 44 extends inward into the element support 36 and merges with a straight portion 48 which extends further into the element support 36. The V-shaped notch 44 facilitates insertion of the heater element 38 into the slot 40 and particularly into the straight portion 48. Of course, slots 40 having other shapes may also be used.

FIGS. 2, 3, and 5 show the heater element assembly 12 having a single row of coils 56. However, multiple rows of coils 56 may be provided. For example, FIG. 1 shows two rows of coils 56. Each row of coils 56 may be made from separate heater element wires 38. Alternatively, a continuous single wire element 38 may be used to form all of the coils 56. As discussed above, the coils 56 are preferably oriented in rows. However, the coils 56 could be oriented in other patterns if desired.

During manufacture of the heater element assembly 12, heater element supports 34, 36 are made from mica board. Preferably, the top element support 34 and the bottom element support 36 are the same. The apertures 42 and slots 40 are formed in the mica board element supports 34, 36. The element supports 34, 36 are positioned at a predetermined distance apart from each other.

The element 38 is preferably constructed from a continuous coil which is subsequently altered by stretching portions of the coil to form linear segments 58 separated by coil segments 56. This may be done by conventional wire coil forming techniques. The element 38 is then bent at select areas such that the coils are in general alignment for securing in the heater element assembly. In the preferred embodiment, a right angle bend is provided in the element 38 at each end of the coils, and the coils are adjacent to and parallel with one another. The coils are preferably shorter than the space provided between the element supports. In this manner, the coil of the element 38, once secured in position between the element supports 34, 36, are in tension.

Preferably, alignment of the element 38 with the element supports 34, 36 is facilitated by providing a small loop, or dimple, (not shown) in the element 38 in each linear segment. This small loop, or dimple, is formed in the linear segment at a position which is in alignment with the aperture of the respective element support 34, 36. In this embodiment, the small dimple engages the aperture 42 when the element 38 is positioned in place for securing the element 38 to the element supports 34, 36. The element 38 is then secured to the element supports 34, 36 by the force of a staking tool, which extends the element 38 through the aperture 42, thereby forming an extended loop 62 of the element 38. In the embodiment in which the element support (34, 36) is constructed of a thin board constructed of mica, of similar non-conductive material, the element 38 is partially embedded into the element support when the loop 62 is extended through the aperture 42. Regardless of the type of material used for the element supports, however, the operation of extending the loop 62 through the aperture 42 causes the coil portions 56 of the element 38 to be drawn toward the respective element support, thereby increasing the tension on the coil portion and causing the terminal ends 56*a*, 56*b* of the respective coil 56 to engage the surface of the respective element support 34, 36.

While the preferred embodiments have been illustrated and described, numerous changes and modifications can be made without significantly departing from the spirit and scope of this invention. Therefore, the inventors intend that such changes and modifications be covered by the appended claims.

What we claim is:

1. A heater element assembly for an electric heater, the assembly comprising:

first and second spaced element supports, said first spaced element support having a peripheral edge surface and first and second slots extending inwardly from said edge surface, and an aperture therebetween; and a resistive heating element including first and second coiled sections and a connecting section disposed therebetween, said connecting section including a mediate loop portion, wherein said first and second coiled sections are disposed between and engage said first and second spaced element supports, and said connecting section extends through said slots and said loop portion extends through said aperture to secure said resistive heating element to said first element support.

2. The assembly of claim 1 including means for securing said heating element to said second element support, wherein said second spaced element support has a peripheral edge surface and slots extending inward from said surface, and an aperture therebetween;

a second connecting section extends through said slots of the second element support, said second connecting section having a loop portion extending through said aperture of said second element support.

3. The heater element assembly of claim 1 wherein one of the coiled sections is in tension.

4. The assembly of claim 1 wherein said heating element includes at least three coiled sections and respective connecting sections disposed therebetween, said second spaced element support has a peripheral edge surface and first and second slots extending inwardly from said edge surface, and an aperture therebetween and an other of said connecting sections extends through said slots and said corresponding loop portion extends through said aperture to secure said resistive heating element to said second element support.

5. A heater element assembly, the assembly having first and second spaced element supports and a heater element comprising a plurality of sequential coiled segments and a respective plurality of linear segments therebetween, wherein:

the element supports include a plurality of spaced notch openings separated by at least one aperture in general alignment between said notch openings, the heater element is fastened to the first and second element supports such that the coiled segments pass between the element supports and the linear segments pass between the spaced notch openings and, the linear segment has an intermediate section including a loop passing through the aperture.

6. The heater element assembly of claim 5 wherein:

the first and second supports are comprised of a semi-rigid material; and the linear segment is partially embedded into the support material.

7. The heater element assembly of claim 5 wherein one of the coiled segments is in tension.

8. The heater element assembly of claim 5 wherein one of the coiled segment includes a first and second terminal coil, each terminal coil being adjacent to a linear segment and in contact with a surface of the element supports.

9. The heater element assembly of claim 5 wherein the element supports are constructed of mica.

10. An electrical heater assembly comprising:

a first element support spaced apart from a second element support and, a heating element having first, second and third portions, said first portion extending from the first element support to the second element support, said second portion connecting the first portion to a third portion, the second portion having a section that extends through the second element support towards the first element support and extends back toward the second element support, and said third portion extending from the second element support to the first element support.

11. The electrical heater assembly of claim 10 wherein the first and third portions of the heating element are heating coils.

12. The electrical heater assembly of claim 10 wherein the second portion comprises:

a first segment connected to the first portion and extending through the second element support;

a second segment connecting the first segment to a looped segment, the looped segment extending through the second element support toward the first element support; and a third segment connecting the looped segment to a fourth segment, the fourth segment extending through the second element support and connected to the second portion.

13. A method of assembling a heater element assembly for an electric heater comprising the steps of:

providing first and second spaced element supports, said first spaced element support having a peripheral edge surface and first and second slots extending inwardly from said edge surface, and an aperture therebetween;

providing a resistive heating element including first and second coiled sections and a connecting section disposed therebetween, said connecting section including a mediate loop portion;

disposing said first and second coiled sections between and in engaging relation with said first and second spaced element supports such that said connecting section extends through said slots; and extending said loop portion through said aperture to secure said resistive heating element to said first element support.

14. The method of claim 13, also including the steps of:

providing a heating element which includes at least three coiled sections and respective connecting sections disposed therebetween, said second spaced element support having a peripheral edge surface and first and second slots extending inwardly from said edge surface, and an aperture therebetween;

extending an other of said connecting sections through said slots of said second support; and extending said corresponding loop portion extending through said aperture of the second support, such that the heating element is secured to said second element support.

15. A method of assembling a heater element assembly comprising the steps of:

providing first and second spaced element supports having a plurality of spaced notch openings separated by at least one aperture in general alignment between notch openings;

providing a heater element having a plurality of sequential coiled segments and at least one linear segment between said sequential coiled segments;

forming a loop in the linear segment;

fastening the heater element to the first and second element supports such that the coiled segments pass between the element supports and the linear segments pass between the spaced notch openings and said loop is aligned with the aperture; and extending the loop such that the loop passes through the aperture.

* * * * *